United States Patent [19]

Buder

[11] Patent Number: 4,991,803

[45] Date of Patent: Feb. 12, 1991

[54] PAINT BRUSH HOLDER

[75] Inventor: James E. Buder, Kitchener, Canada

[73] Assignee: J. Buder & Co. Inc., Kitchener, Canada

[21] Appl. No.: 470,115

[22] Filed: Jan. 25, 1990

[51] Int. Cl.[5] ..... A46B 17/02

[52] U.S. Cl. ..... 248/113; 248/213.2

[58] Field of Search ..... 248/110, 113, 210, 316.7, 248/231.7, 213.2

[56] References Cited

U.S. PATENT DOCUMENTS

| | | | |
|---|---|---|---|
| 1,622,058 | 3/1927 | Sohnle | 248/113 |
| 2,674,391 | 4/1954 | Davis | 248/113 |
| 2,703,652 | 3/1955 | Dominik | 248/316.7 X |
| 2,786,707 | 3/1957 | Campbell | 248/113 |
| 3,182,943 | 5/1965 | Crossman | 248/231.7 X |
| 3,357,668 | 12/1967 | Carrel | 248/113 |
| 3,425,012 | 1/1969 | Gottinger . | |
| 3,536,187 | 10/1970 | Stafford . | |
| 3,536,285 | 10/1970 | Vaughn . | |
| 3,688,943 | 9/1972 | Brown . | |
| 3,729,158 | 4/1973 | Nagy . | |
| 3,948,413 | 4/1976 | Gorrell et al. . | |
| 4,025,206 | 5/1977 | Rubin . | |
| 4,266,686 | 5/1981 | Carter | 248/113 X |
| 4,266,746 | 5/1981 | Klaiber | 248/113 |
| 4,903,929 | 2/1990 | Hoffman | 248/231.7 X |

*Primary Examiner*—Gary L. Smith
*Assistant Examiner*—Michael J. Milano
*Attorney, Agent, or Firm*—Merchant, Gould, Smith, Edell, Welter & Schmidt

[57] ABSTRACT

The invention provides a paint brush holder for holding a paint brush by its handle in a generally horizontal position over the rim of an open paint can. The holder includes resilient, spaced leg members joined by a U-shaped connection to grip the rim of the paint can. A clip structure holds the paint brush handle and includes a plate member positioned horizontally above the U-shaped connection and a resilient connection structure interconnecting the U-shaped connection and the plate member. The paint brush handle is received and retained between the plate member and the U-shaped connection.

10 Claims, 1 Drawing Sheet

PAINT BRUSH HOLDER

FIELD OF THE INVENTION

This invention relates to paint brush holders adapted to hold a paint brush over the rim of an open paint can.

BACKGROUND OF THE INVENTION

Holders, clips or caddies are known in the art for elevating a paint brush over a paint can when the brush is not in use. Many of the known devices suffer the disadvantage of not holding the brush over the open paint can itself, leading to messy paint dripping around the can. Devices which hold the paint brush over the open can, while known, are often overly complex or cumbersome or can damage the bristles of the paint brush.

U.S. Pat. No. 4,025,206, issued May 24, 1977 to Rubin shows a paint brush holder adapted to hold the brush at an angle over the open paint can. However, the brush itself is held in place by means of a hook on a yoke which extends beyond the can's perimeter, taking up considerable space. Also, the means for clipping the yoke to the paint can is somewhat cumbersome, requiring the attachment of an elastic around wire members and the can itself.

U.S. Pat. No. 3,729,158, issued Apr. 24, 1973, to Nagy shows another paint brush holder which uses a magnetic attachment to the paint brush in order to hold the brush in place above the paint can.

U.S. Pat. No. 3,182,943, issued May 11, 1965 to Crossman illustrates a paint brush holder which uses a manual and somewhat cumbersome clamp to hold the device onto the paint can and spring clips to grasp the handle of the brush over the paint can.

U.S. Pat. No. 3,948,413, issued Apr. 6, 1976 to Gorrell et al includes an inclined support above the paint can on which the paint brush may be laid when not in use. A device such as this can damage the paint brush bristles since the brush is mainly supported by the bristles when not in use. The device also becomes covered with paint requiring clean up after use.

There is a need for a simple, compact and inexpensive paint brush holder which clips onto the rim of an open paint can and which holds the paint brush, when not in use, by its handle such that the brush end is generally horizontally suspended over the open can to catch any paint drips.

SUMMARY OF THE INVENTION

The present invention provides a paint brush holder having at least two resilient leg members spaced from each other and joined at the upper ends in a U-shaped connection such that the lower ends are biased inwardly toward each other to grip the rim of a paint can. The U-shaped connection forms a lower plate member parallel to and above the paint can rim. Connected above the U-shaped connection, and preferably integral therewith, is a clip means for holding the paint brush. The clip means provides an upper plate member positioned above and parallel to the lower plate member and resilient connection means interconnecting the upper and lower plate means. The resilient connection means downwardly bias the upper plate member such that a paint brush handle can be received and retained between the upper and lower plate members.

DESCRIPTION OF THE PREFERRED EMBODIMENT

Figure 1:
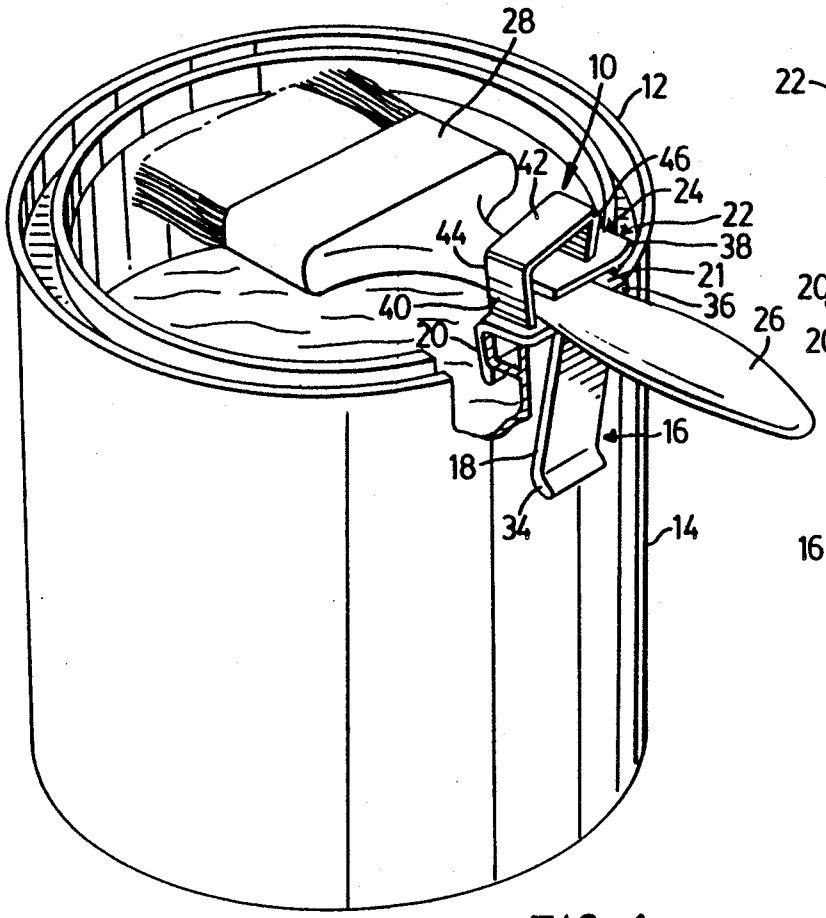
FIG. 1 is a perspective view of the paint brush holder fastened to the rim of an open paint can and holding a paint brush over the open can.

The paint brush holder of this invention, illustrated generally as numeral 10 in the Figures, is shown in FIG. 1 fastened to the upper rim 12 of an open paint can 14. The lower portion 16 of the holder 10 is seen to include spaced leg members 18, 20 connected through a U-shaped connection 21 (best illustrated in FIGS. 2 and 3), which co-operate to grip the rim 12 of the paint can 14. The upper portion 22 of the holder 10 is seen to include clip means 24, operative to hold the handle 26 of the paint brush 28 generally horizontally over the open paint can 14 such that any paint dripping from the brush 28 can be caught by the open can 14.

Preferably, the upper and lower portions 16, 22 of the holder 10 are integral, formed from a resilient plastic material such as polypropylene which has the desired spring-like quality and memory to allow for the bending, gripping and holding functions of the holder. Other resilient materials such as spring sheet metal or other resilient plastics may also be employed.

Figure 3:
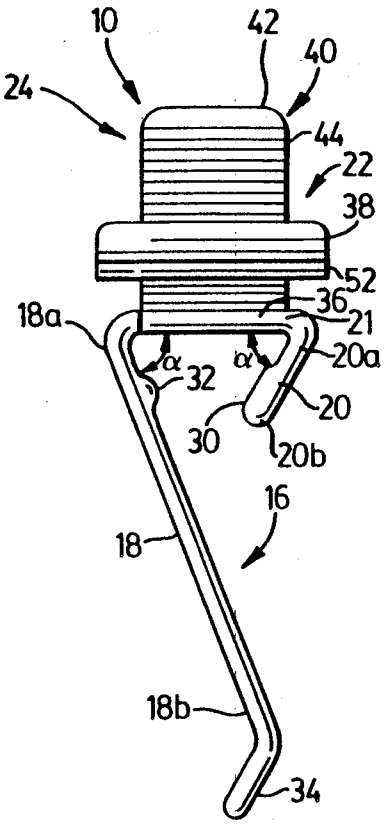
FIG. 3 is an end view of the paint brush holder illustrating the leg members to fasten the holder to the paint can rim.
Figure 2:
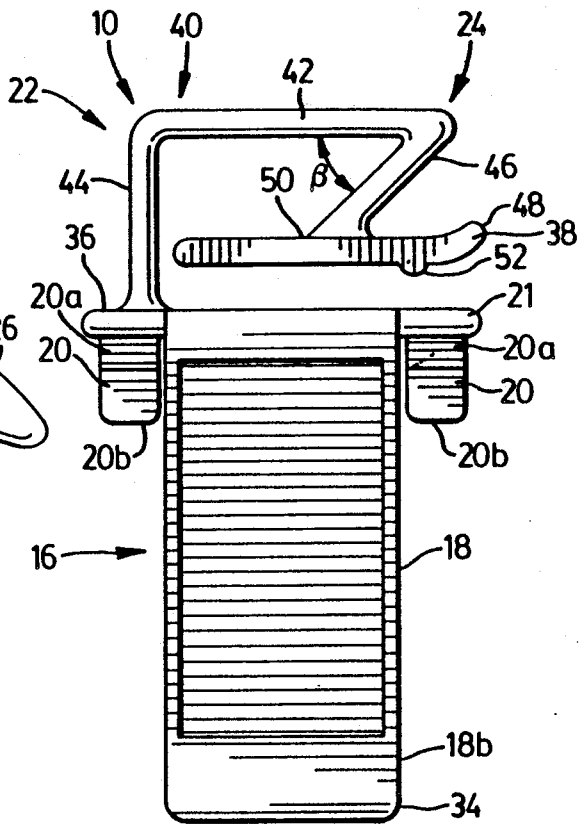
FIG. 2 is a side view of the paint brush holder illustrating the clip means for holding the paint brush above the paint can.

As best seen in FIGS. 2 and 3, one of the leg members 18 is preferably longer than the other leg members 20 in order to grip the exterior of the paint can 14. The leg members 18, 20 are biased inwardly toward each other. The upper ends **18*a*, 20*a* of the leg members 18, 20 are joined together through the U-shaped connection 21. The leg members 20, which grip inside the paint can 14 are preferably of a length such that the free lower ends 20*b* terminate just below the paint can rim 12. These lower ends 20*b* are preferably formed with inwardly depending lugs 30 which contact the paint can 14 just below its rim 12. These lugs 30 grip the rim 12 and apply a lateral pressure against the longer leg member 18 and maintain the lower plate member 36 in its horizontal position. As illustrated in the Figures, the holder 10 includes two leg members 20 spaced from each other along one side of the U-shaped connection 21. This arrangement provides the desired gripping action and strength while minimizing the amount of resilient material used in the manufacture. However, it should be understood that the holder 10 can be formed with single or multiple leg members spaced on either side of the U-shaped connection 21**.

The longer leg member 18 preferably includes an inwardly depending lug 32 proximate its upper connected end **18*a* to contact the paint can just below its rim 12 and prevent the holder 10 from slipping off. At the lower end 18*b* of the longer leg member 18 is an outwardly projecting flange 34. The holder 10 can be removed from the paint can 14 by lifting the flange 34** upwardly in a prying action.

The angle $\alpha$ contained between each of the leg members 18, 20 and the U-shaped connection is preferably less than about 90°. While the holder 10 may be formed with this angle being anywhere between about 10° and 90°, the angle is preferably between about 30° and 60°, to achieve the desired gripping action around the paint can rim 12.

The longer leg member 18 is preferably formed with sufficient width and length to provide for markings or the attachment of a label thereon for advertising or labelling purposes.

As best shown in FIGS. 1 and 2, the U-shaped connection 21 between the leg members 18, 20 serves another purpose, that is to provide a lower plate member 36 of the clip means 24. This lower plate member 36 extends generally parallel to and above (i.e. generally horizontally) the paint can rim 12 when the holder 10 is fastened thereto. Spaced above and substantially parallel to the lower plate member 36 is an upper plate member 38. As shown in FIG. 3, the upper plate member 38 is preferably of greater width than the lower plate member 36 in order to provide greater strength thereto. The plate members 36, 38 are connected in this parallel, spaced arrangement through resilient connection means 40 which downwardly biases the upper plate member 38. This resilient connection means 40 allows the upper plate member 38 to move upwardly to receive the handle 26 of the paint brush 28, while maintaining a downward biasing force on the upper plate member 38 to retain the brush handle 26 in this position.

Preferably, the resilient connection means 40 includes a spring plate member 42 positioned above and generally parallel to the upper plate member 38, a first arm member 44 extending generally vertically between and connecting one end of the lower plate member 36 to one end of the spring plate member 42, and a second arm member 46 connecting the other end of the spring plate member 42 to the upper plate member 38.

With reference to FIG. 2, the end of the upper plate member 38 which is remote from the first arm member 44 is termed the lead-in end 48 as the paint brush handle is received between the upper and lower plate members 38, 36 from that end. To achieve the desired resilience and strength in the connection means 40 when the first arm member 44 is generally vertical and the spring plate member 42 is generally horizontal, the second arm member 46 is preferably connected to the upper plate member 38 at a point between the midpoint 50 and the lead-in end 48 of the upper plate member 38. The angle $\beta$ between the spring plate member 42 and the second arm member 46 is preferably between about 10° and 92°, most preferably between about 30° and 60°.

Other embodiments of the resilient connection means 40 which would be operative to downwardly bias the upper plate member 38 will be evident to persons skilled in the art. For instance, the spring plate member 42 could be eliminated and an inclined arm (not shown) could be provided between the first arm member 44 and the upper plate member 38. The embodiment shown herein is preferred for the strength and degree of resilience it imparts in the connection.

To prevent the paint brush handle 26 from slipping out from between the upper and lower plated members 38, 36 a downwardly depending lug 52 is included on the upper plate member 38 proximate its lead-in end 48.

While the present invention has been described in connection with the preferred embodiment thereof, it should be understood that there may be other embodiments which fall within the spirit and scope of the invention as defined by the following claims.

I claim:

1. A paint brush holder adapted to hold a paint brush generally horizontally over the rim of an open paint can, comprising:

resilient leg members spaced from each other and joined at the upper ends in a U-shaped connection such that the lower ends are biased inwardly toward each other to grip the upper rim of the open paint can, the U-shaped connection forming a lower plate member which extends parallel to and above the upper rim of the paint can when the holder is fastened to the rim; and clip means connected above the U-shaped connection to hold the paint brush, the clip means comprising an upper plate member positioned above the lower plate member and extending generally parallel thereto, and resilient connection means connecting the upper and lower plate members, the resilient connection means comprising a spring plate member positioned above and generally parallel to the upper plate member, a first arm member extending generally vertically between and connecting one end of the lower plate member to one end of the spring plate member, and a second arm member connecting the other end of the spring plate member to the upper plate member, the resilient connection means being operative to downwardly bias the upper plate member, whereby a paint brush handle may be received and retained between the upper and lower plate members.

2. The paint brush holder of claim 1, wherein the clip means is formed from a resilient material.

3. The paint brush holder of claim 2, wherein the clip means is formed from polypropylene.

4. The paint brush holder of claim 3, wherein the angle contained between the spring plate member and the second arm member is between 10 and 92 degrees.

5. The paint brush holder of claim 4, wherein the end of the upper plate member remote from the first arm member is the lead-in end for receiving the paint brush handle and wherein the second arm member is connected to the upper plate member at a point intermediate the midpoint and the lead-in end of the upper plate member.

6. The paint brush holder of claim 5, wherein the upper plate member includes a downwardly depending lug proximate the lead-in end of the plate member to prevent the paint brush handle from sliding out of its retained position between the upper and lower plate members.

7. The paint brush holder of claim 6, wherein the leg members are formed of a resilient plastic material.

8. The paint brush holder of claim 7, wherein the leg members are formed of polypropylene.

9. The paint brush holder of claim 8, wherein one of the leg members is longer than the other and is adapted to grip the exterior wall of the paint can.

10. The paint brush holder of claim 9, wherein each of the leg members includes an inwardly depending lug to contact the paint can just below the rim to grip the rim.

* * * * *